US005413837A

United States Patent [19]

Rock et al.

[11] Patent Number: 5,413,837

[45] Date of Patent: May 9, 1995

[54] THREE-DIMENSIONAL KNIT FABRIC

[75] Inventors: Moshe Rock, Andover; Douglas Lumb, Methuen, both of Mass.

[73] Assignee: Malden Mills Industries, Inc., Lawrence, Mass.

[21] Appl. No.: 221,659

[22] Filed: Apr. 4, 1994

Related U.S. Application Data

[63] Continuation of Ser. No. 906,614, Jun. 30, 1992, abandoned.

[51] Int. Cl.[6] ..... B32B 23/02

[52] U.S. Cl. ..... 428/192; 428/81; 428/116; 428/118; 428/195; 428/246; 428/253; 428/309.9

[58] Field of Search ..... 428/81, 116, 118, 192, 428/195, 246, 253, 309.9

[56] References Cited

U.S. PATENT DOCUMENTS

| | | | |
|---|---|---|---|
| 2,909,784 | 10/1959 | Forsberg . | |
| 4,136,222 | 1/1979 | Jonnes | 428/116 |
| 4,194,041 | 3/1980 | Gore et al. | 428/422 |
| 4,211,815 | 7/1980 | Denier | 428/290 |
| 4,262,046 | 4/1981 | Eitel | 428/69 |
| 4,389,447 | 6/1983 | Disselbeck et al. | 428/178 |
| 4,420,521 | 12/1983 | Carr | 428/74 |
| 4,508,775 | 4/1985 | Adiletta | 428/240 |
| 4,550,046 | 10/1985 | Miller | 428/116 |
| 4,601,490 | 7/1986 | Fischer | 428/178 |
| 4,761,324 | 8/1988 | Rautenberg et al. | 428/198 |
| 4,787,219 | 11/1988 | Sato et al. | 66/190 |
| 4,797,311 | 1/1989 | Kemp | 428/92 |
| 4,803,116 | 2/1989 | Amano et al. | 428/286 |
| 4,879,169 | 11/1989 | Zafiroglu | 428/230 |
| 4,880,681 | 11/1989 | Price et al. | 428/116 |
| 4,895,751 | 1/1990 | Kato et al. | 428/245 |
| 5,026,591 | 6/1991 | Henn et al. | 428/198 |

*Primary Examiner*—Christopher W. Raimund
*Attorney, Agent, or Firm*—Gottlieb, Rackman & Reisman

[57] ABSTRACT

A three-dimensional knit or woven fabric that is permeable to water vapor but impermeable to liquid water is provided. The fabric includes a first fabric layer, a second fabric layer and a yarn interconnecting the two layers. The two layers and the yarn are preferably made from a synthetic, such as a polyester or nylon. Both the first and second fabric layers have a barrier layer adhered to the outside surfaces thereof which is both impermeable to liquid water and permeable to water vapor. The fabric is imperviously sealed to prevent the infiltration of water.

20 Claims, 1 Drawing Sheet

THREE-DIMENSIONAL KNIT FABRIC

This application is a continuation of application Ser. No. 07/906,614, filed Jun. 30, 1992, now abandoned.

BACKGROUND OF THE INVENTION

This invention relates to a three-dimensional knit or woven fabric, and more particularly to a three-dimensional knit or woven fabric having first and second fabric layers. A barrier layer which is both impermeable to liquid water and permeable to water vapor is adhered to each of the fabric layers.

Many work and recreational activities take place on, near or in the water. For these types of activities, there is a need for a suit material that is both warm and insulating but which also prevents the passage of water therethrough.

One such prior art construction is a suit made of a "neoprene" synthetic rubber material. A typical neoprene suit comprises bubble enclosures containing a gas for providing warmth and an outside material which is impermeable to liquid water. However, prior art neoprene suits are less than desirable. Neoprene suits fail to have sufficient moisture transport characteristics, especially if the wearer of the suit is working or exercising for an extended period of time. Moreover, neoprene suits tend to be rather bulky, are not particularly suitable as a flotation device and generally do not provide a comfortable garment for the wearer.

Accordingly, it would be desirable to provide a textile fabric which overcomes the above disadvantages and which is impermeable to liquid water while facilitating water vapor transport away from the skin or undergarment of the wearer.

SUMMARY OF INVENTION

Generally speaking, in accordance with the invention, a three-dimensional knit or woven fabric that is permeable to water vapor but impermeable to liquid water is provided. The fabric includes a first fabric layer, a second fabric layer and yarn interconnecting the two layers. The two layers and the yarn are preferably made from a synthetic, such as a polyester, acrylic or nylon. Both the first and second fabric layers have a barrier layer applied to the outside surfaces thereof which is both impermeable to liquid water and permeable to water vapor.

The barrier layer that is applied to the fabric layers is selected based on the desired use of the three-dimensional fabric, for instance, either in water use or land use. The barrier layer may be either hydrophilic and monolithic or hydrophobic and microporous and may be made from a number of polymer materials that are elastomeric and thermoplastic.

In application, the three-dimensional fabric of the invention is used for garments that are intended to be worn in cold land or water environments. Because of the barrier layer applied to the fabric layers, liquid water will not pass through the garment. Nevertheless, moisture from the skin is quickly transported through the barrier layer and through the first and second fabric layers of the three-dimensional fabric.

It is significant that the knit or woven fabric of the invention has a three-dimensional structure. Because of this construction, air is trapped therein, rendering the fabric insulative. In addition, in water, a person wearing a garment made of the inventive three-dimensional knit fabric is kept afloat because the trapped air in the fabric increases the buoyancy of the garment. In fact, a garment made of the inventive fabric is significantly lighter than a neoprene suit due to the increased entrapment of air therein.

Accordingly, it is an object of the invention to provide an improved knit or woven fabric construction for enhancing the transport of body moisture away from the skin or undergarment.

It is also an object of the invention to provide an improved three-dimensional knit or woven fabric that is coated with a barrier layer that is both permeable to water vapor but impermeable to liquid water.

Another object of the invention is to provide an improved three-dimensional knit or woven fabric which is breathable.

A further object of the invention is to provide a three-dimensional knit or woven fabric which is sufficiently resilient.

Still another object of the invention is to provide a three-dimensional knit or woven fabric which is puncture and tear resistant.

Yet a further object of the invention is to provide a three-dimensional knit or woven fabric which is insulative.

Still other objects and advantages of the invention will in part be obvious and will in part be apparent from the following description.

The invention accordingly comprises the several steps, and the relation of one or more of the steps with respect to each of the others, as well as the material or materials having the features, properties and relation of constituents, all as exemplified in the following detailed disclosure; the scope of the invention will be indicated in the claims.

BRIEF DESCRIPTION OF THE DRAWINGS

Reference is made to the following description, taken in connection with the accompanying drawings in which.

DETAILED DESCRIPTION

Figure 1:
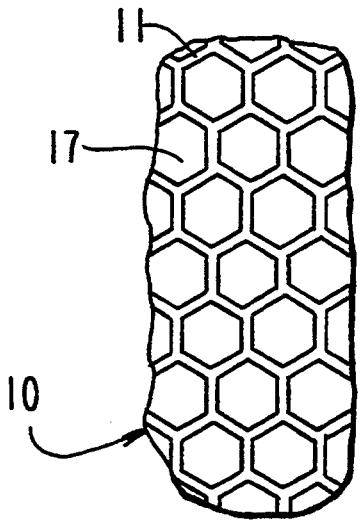
FIG. 1 is a front elevational view of the three-dimensional knit or woven fabric of the invention.
Figure 2:
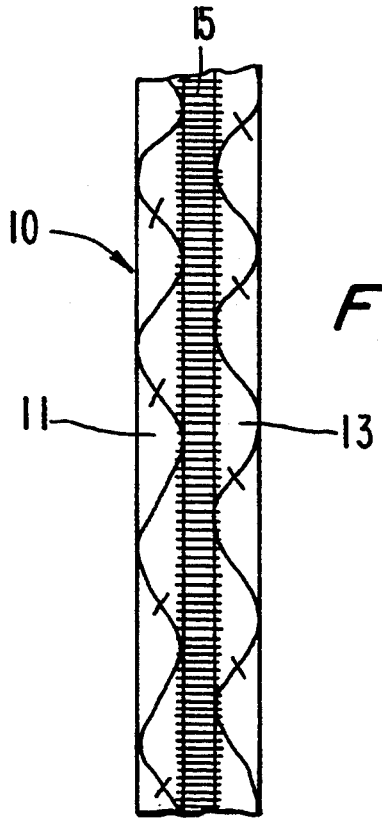
FIG. 2 is a sectional view of the three-dimensional knit fabric illustrated in FIG. 1.

As illustrated in FIGS. 1, the three-dimensional knit or woven fabric of the invention, generally indicated at 10, includes a first fabric layer 11, a second fabric layer 13 and a plurality of yarns or yarn elements 15 interconnecting layers 11 and 13. Each of layers 11 and 13 is coated with a barrier layer that is impermeable to liquid water but permeable to water vapor. In the embodiment illustrated, the fabric has a honeycomb configuration defined by a plurality of pores 17. Other configurations are possible such as basket weave, or any knit construction.

The three-dimensional knit or woven fabric of the invention is either woven on a double-plush loom or knit on a double needle bar warp knitter. These two machines are commonly used in the manufacture of velvet and are well known in the art. In the production of velvet, the yarn connecting the two surfaces is cut, resulting in two pieces of a velvet or plush fabric. However, in accordance with this invention, the double layer is left uncut and the yarn maintains the connection between the two fabric layers, facilitating the formation of the three-dimensional structure.

In preparing the three-dimensional knit or woven fabric of the invention, the thread or yarn that is used is preferably a synthetic material such as a polyester, acrylic or nylon. The yarn or thread may be a monofilament or spun, texturized or fully oriented.

The yarn interconnecting the two layers of the inventive three-dimensional knit or woven fabric should have sufficient resilience and stiffness to keep the two fabric layers apart even if pressure is applied to any one of the fabric layers. In construction, the interconnecting yarn is made of either the same or a different material than that of the two fabric layers. Particularly, in order to render the interconnecting yarn resilient, the yarn may be made of a resilient material such as monofilament or multi-filament polyester, nylon, etc. Preferably, the interconnecting yarn has a fineness of between about 300 and 5,000 denier. As discussed above, a barrier layer is applied to both the first and second fabric layers in order to render the fabric layers impermeable to liquid water but permeable to water vapor. The barrier layer that is chosen to be applied to the two fabric layers may be hydrophilic and monolithic or hydrophobic and microporous and may be made from any number of materials, including porous polyethylene, polysulfone polysiloxane, polyether-polyester and polyurethane or a block polymer of any of the above.

The barrier layer that is deposited on the fabric layers is specifically selected based on the intended use of the three-dimensional fabric. For example, if the three-dimensional knit or woven fabric is to be used in a garment suitable for working in water, the film that is chosen would be resistant to hydrostatic pressure. Suitable films of this nature include polyvinyl chloride, polypropylene and polyethylene.

On the other hand, if the garment incorporating the three-dimensional knit or woven fabric of the invention is to be worn when conducting activities on land, a film with good moisture vapor transmission characteristics is chosen. Suitable films include polyurethane, polysiloxane and polysulfane.

The barrier layer is applied to the two fabric layers by one of a number of methods well known in the art. These include transfer coating, in which the barrier layer is first placed or laid on a carrier. Thereafter, the film is placed on the fabric layer, and the carrier is then discarded.

Additional methods for applying the film include direct lamination of an extruded film as well as direct roller coating of a solution onto the fabric layers from which the solvent is then evaporated.

A further method for applying the barrier layer is first applying an adhesive on the fabric layer by spraying or gravure printing and then placing a self-supporting film on top of the adhesive in the manner of lamination.

Preferably, and in order to promote air entrapment, the edges of the three-dimensional knit or woven fabric of the invention are sealed before incorporation into a garment. This is achieved by either having the edges along the fabric sheet sealed directly or by preparing the fabric in quilted form. The sealing of the fabric promotes ambient air entrapment so that it is insulative, so that moisture from the outside is kept out and so that buoyancy for flotation is retained. Sealing may be achieved by such conventional processes as thermal bonding, ultrasound bonding, chemical bonding, radio frequency welding or laser fusion. Quilting may be achieved by embossing the fabric to create a pillow-like structure.

In some embodiments, another fabric layer may be adhered to either of the barrier layers deposited on the fabric layers. The additional fabric layer may be added in order to promote puncture and tear resistance and would be located towards the outside of the article or garment. This additional outer fabric layer is either a highly dense knit or a woven "shell." It may be made of a nylon or polyester material. Other materials may be chosen if they exhibit the appropriate physical and functional characteristics.

An additional fabric layer may also be added for both comfort to the skin and to promote body moisture transport; this layer would be located towards the inside of the garment. This additional inner layer may be made of a material that is soft to the skin, such as a raised fleece.

The preferred three-dimensional fabric of the invention is a knit which has improved stretch and drape characteristics.

It will thus be seen that the objects set forth above, and those made apparent from the preceding description, are efficiently attained. Since certain changes may be made in the product set forth above without departing from the spirit and scope of the invention, it is intended that all matter contained in the above description shall be interpreted as illustrative and not in a limiting sense.

It is also to be understood that the following claims are intended to cover all the generic and specific features of the invention herein described, and all statements of the scope of the invention which, as a matter of language, might be said to fall there-between.

We claim:

1. A three-dimensional knit or woven fabric comprising:

a first fabric layer having an outer surface, a second fabric layer having an outer surface, and a yarn interconnecting the two layers, wherein the outer surfaces of each of the first and second layers has a barrier layer applied thereto without the addition of an intermediate adhesive that is both impermeable to liquid water and permeable to water vapor, wherein the fabric has edges therealong that are imperviously sealed to promote air entrapment, to prevent infiltration of water and to retain buoyancy.

2. The fabric of claim 1, wherein the interconnecting yarn has sufficient resilience and stiffness to maintain the two fabric layers apart.

3. The fabric of claim 1, wherein the barrier layer is applied to the fabric layers by a method selected from the group consisting of transfer coating, direct lamination and direct roller coating.

4. A three-dimensional knit or woven fabric comprising:

a first fabric layer having an outer surface, a second fabric layer having an outer surface, and a yarn interconnecting the two layers wherein the first and second fabric layers and the interconnecting yarn define a plurality of honeycomb shaped pores with air entrapped therein in order to render the fabric insulative, wherein the outer surface of each of the first and second layers have a barrier layer adhered thereto that is both impermeable to liquid water and permeable to water vapor, wherein the fabric has edges therealong that are imperviously sealed to promote air entrapment, to prevent infiltration of water and to retain buoyancy.

5. The fabric of claim 4, wherein the interconnecting yarn has sufficient resilience and stiffness to maintain the two fabric layers apart.

6. The fabric of claim 5, wherein said interconnecting yarn is made of a resilient material.

7. The fabric of claim 5, wherein the interconnecting yarn has a fineness of between about 300 and 5,000 denier.

8. The fabric of claim 4, wherein said barrier layer is resistant to hydrostatic pressure.

9. The film of claim 4, wherein said barrier layer promotes moisture vapor transmission.

10. The fabric of claim 4, wherein said barrier layer is hydrophilic and monolithic.

11. The fabric of claim 4, wherein said barrier layer is hydrophobic and microporous.

12. The fabric of claim 4, wherein said barrier layer is selected from the group consisting of polyethylene, polyvinyl chloride, polysulfane, polysiloxane, polyether-polyester and a block copolymer of any of the above.

13. The fabric of claim 1, wherein the barrier layer is applied to the fabric layers by a method selected from the group consisting of transfer coating, direct lamination, adhesive bonding and direct roller coating.

14. The fabric of claim 4, wherein said fabric is quilted.

15. The fabric of claim 1, wherein a further fabric layer is adhered to at least one of said barrier layers.

16. The fabric of claim 4, wherein a third fabric layer is adhered to one of said barrier layers and a fourth fabric layer is adhered to the other of said barrier layers.

17. The fabric of claim 16, wherein said third fabric layer is made of a raised fleece material.

18. The fabric of claim 16, wherein said fourth fabric layer is selected from the group consisting of a highly dense knit fabric and a woven shell fabric.

19. The fabric of claim 4, wherein the barrier layer is applied to the outer surfaces of each of the first and second layers without the addition of an intermediate adhesive.

20. A three-dimensional knit or woven fabric comprising:

a first layer having an outer surface;

a second fabric layer having an outer surface; and a yarn interconnecting the two layers having sufficient resilience and stiffness to keep the first and second fabric layers apart even if pressure is applied to any one of the first and second fabric layers, wherein the first and second layers and the yarn define a plurality of pores with air entrapped therein in order to render the fabric insulative, wherein the outer surfaces of each of the first and second layers have a barrier layer applied thereto that is resistant to hydrostatic pressure, impermeable to liquid water and permeable to water vapor;

wherein the fabric has edges therealong that are imperviously sealed to promote air entrapment, to prevent infiltration of water and to retain buoyancy.

* * * * *